US006374555B1

(12) United States Patent
Gusler

(10) Patent No.: US 6,374,555 B1
(45) Date of Patent: Apr. 23, 2002

(54) LONG LASTING DECK PRODUCT

(76) Inventor: Jay Gusler, 765 W. Beech St., Long Beach, NY (US)

( * ) Notice: Subject to any disclaimer, the term of this patent is extended or adjusted under 35 U.S.C. 154(b) by 0 days.

(21) Appl. No.: 09/336,223

(22) Filed: Jun. 18, 1999

(51) Int. Cl.[7] ..... E04I 11/16

(52) U.S. Cl. ..... 52/177; 52/650.3; 52/717.04; 52/717.05; 52/718.04; 52/730.7; 52/731.1; 52/737.3; 52/DIG. 8; 297/184.11; 297/219.11; 108/90

(58) Field of Search ..... 52/730.7, 736.3, 52/738.1, 718.04, 717.04, DIG. 8, 650.3, 204.53, 204.54, 211, 212, 177, 731.1, 736.4, 737.3, 717.05; 297/219.11, 219.1, 184.11, 184.1; 108/90

(56) References Cited

U.S. PATENT DOCUMENTS 2,564,386 A * 8/1951 Webb ..... 5/93.1
3,130,455 A * 4/1964 Borlenghi ..... 52/211
3,271,919 A * 9/1966 Olton ..... 52/800.13
4,885,882 A * 12/1989 Forshee ..... 52/177
4,907,387 A * 3/1990 Turnbull ..... 52/177
5,070,664 A * 12/1991 Groh et al. ..... 52/177
5,326,187 A * 7/1994 St. Marie ..... 403/402
5,351,458 A * 10/1994 Lehe ..... 52/586.2
5,368,360 A * 11/1994 Groh ..... 297/219.1
5,475,952 A * 12/1995 O'Connor ..... 52/177
5,505,517 A * 4/1996 Groh et al. ..... 297/219.1
5,513,896 A * 5/1996 Groh et al. ..... 297/219.1
5,613,339 A * 3/1997 Pollock ..... 52/731.1
5,794,390 A * 8/1998 Oliveri ..... 52/177
5,814,391 A 9/1998 Hutchison et al.
5,819,491 A 10/1998 Davis
5,836,128 A * 11/1998 Groh ..... 52/580
5,851,469 A 12/1998 Muller et al.
5,866,264 A 2/1999 Zehner et al.
5,873,209 A 2/1999 Hagel
5,913,784 A * 6/1999 Hite ..... 52/177
6,088,976 A * 7/2000 Roy ..... 52/179
6,108,992 A * 8/2000 Shaw ..... 52/302.3
6,260,328 B1 * 7/2001 Fowler et al. ..... 52/732.1

* cited by examiner

*Primary Examiner*—Carl D. Friedman
*Assistant Examiner*—Yvonne M. Horton
(74) *Attorney, Agent, or Firm*—Weiss & Weiss PC

(57) ABSTRACT

A deck product comprising a composite and a base. The composite covers the base and the base and the composite are removably attached

14 Claims, 1 Drawing Sheet

LONG LASTING DECK PRODUCT

FIELD OF THE INVENTION

The invention relates to a deck product, and more specifically to a sturdy, all weather deck product.

PRIOR ART

Prior Art decks are made solely of wood which is not resistant to moisture, decay and insects. But wood is very sturdy. When used on major Boardwalks, such as Atlantic City, it allows for vehicles to travel on top of without destroying the underlying deck. A boardwalk is made of wood or treated lumber. Sun and rain causes this wood to splinter and split. This occurs within two years of decking. A boardwalk is usually made of 2×4 wood.

In the past few years extruded wood products have come onto the market. These products are mainly moisture resistant, and are not subject to insect infestation. However, these extruded wood products do not have the strength of their wood counterparts. A vehicle traveling over such a product will injure or destroy the extruded wood product. Another deficiency of these extruded wood products is their design. One prior art extruded wood product has a tongue and groove that allows for drainage. This system blocks up and causes pooling. Pooling allows moisture to take its toll on the extruded wood product. If moisture builds up and freezes this is detrimental to the product and the deck.

U.S. Pat. No. 5,873,209 discloses a construction component which includes a plurality of members of which certain portions are comprised of materials resistant to moisture, decay and insects. The resistant member(s) are integrally connected to wood portion(s) to provide a single, low cost structure.

This invention relates to frames, such as doors, window frames, porch posts, brickmolds and casings. The construction has a first and second section. The second section is made from a material that is durable and moisture, decay and insect resistant. The first section is wood. The wood and the durable section are connected end to end with a glued finger joint or other mechanical connection.

The durable portion may be an extruded wood-based product such as STRANDEX®, ERT®, TREX® or the like, which can be shaped using conventional wood processing techniques. The placing of the durable portion on the lower portion of the frame prevents all but the most severe damage by prior art door frames. This invention raises the wood off the ground so that it is less subject to insects or water damage.

U.S. Pat. No. 5,866,264 discloses a process in which an article of manufacture may be produced which includes a renewable surface on a synthetic wood composite substrate. The invention relates to a wood-polymer composite material suitable for use in place of natural wood. The invention includes the combining of cellulosic material with a thermoplastic material and optionally with a cross-linking agent to form a combined product. Conventional extrusion equipment is used to fuse the combined product under sufficient conditions to blend the combined product into a homogeneous mixture. In a preferred material composition, the synthetic wood material includes two-thirds organic fibrous or cellulosic material and approximately one-third thermoplastic material in combination. The resultant product has an appearance similar to wood. The resultant product is resistant to rot and decay as well as termite attack. The resultant product may be used as: decorative moldings, inside or outside of the house, picture frames, furniture, porch decks, window moldings, window components, door components, roofing systems, and any other type of use where structural requirements do not exceed the physical properties of the resultant material. The invention concerns the addition of a renewable surface onto a synthetic wood material. A renewable surface that may be used in the invention is ENDURAN® or mineral filled PBT®.

U.S. Pat. No. 5,851,469 discloses a method for making a dimensionally stable wood-thermoplastic composite material comprised of a wood component and a thermoplastic component comprising the steps of forming a wood-thermoplastic mass at a temperature of the thermoplastic component.

U.S. Pat. No. 5,836,128 discloses a tongue and groove deck plank made from a wood replacement material. The deck plank is substantially hollow, and generally rectangular. It has a horizontal top and bottom, a tongue on one edge, and a groove on the other. When the tongue of one deck plank and the groove of another are placed next to one another, a space is maintained between a portion of the tongue and a portion of the groove. A deck may be made from the deck planks. The deck has a support, and at least one wood replacement deck plank attached to the support. The deck preferably includes a starter strip attached to the support. This is the type of product that has the deficiency of pooling of water as described above.

U.S. Pat. No. 5,819,491 discloses modular construction elements. An elongate modular decking plank is provided for assembly on a supporting subfloor together with a plurality of like planks to form a decking structure. The decking plank has a top wall spaced-apart from a bottom wall, and opposing laterally spaced downwardly converging side walls interconnecting the top and bottom walls. An integrally-formed flange extends outwardly from the bottom wall on one of the sides of the decking plank. The flange includes a fastening portion for receiving fasteners therethrough to the supporting subfloor to mount the decking plank on the supporting subfloor, and a connecting portion for connecting the plank to an adjacent like plank in a manner which permits limited lateral and angular adjustment between adjacent planks. The plank is preferably extruded from high-impact polymeric material, such as PVC plastic. The invention is a one piece design.

U.S. Pat. No. 5,814,391 discloses a thermoplastic structural piece containing an injection molded portion. The panel may be used to provide sealing ends on thermoplastic panels or to create resiliently closable passages in thermoplastic panels through which wires or other objects may be passed while maintaining an even surface appearance of the baseboard panel.

SUMMARY OF THE INVENTION

The present invention deck product comprises a composite material covering a solid base. The composite material protects the base from sun, rain and other related damage. It is an object of the present invention to provide a longer lasting deck. The composite material gives the benefit of water resistance, and wet and dry traction. It is also pleasant to the foot and can be uv protected.

It is an object of the present invention that the deck product be capable of being put right on top of existing decks or could be used as a deck product by itself. If the deck product of the present invention is placed on top of an already existing deck, the base of the present invention can be of a lesser strength.

A further object of the present invention is to allow the composite material and the base to move independently because of the different expansion rates.

DESCRIPTION OF THE PREFERRED EMBODIMENTS

The present invention is described in detail with reference to the attached drawings.

Figure 1:
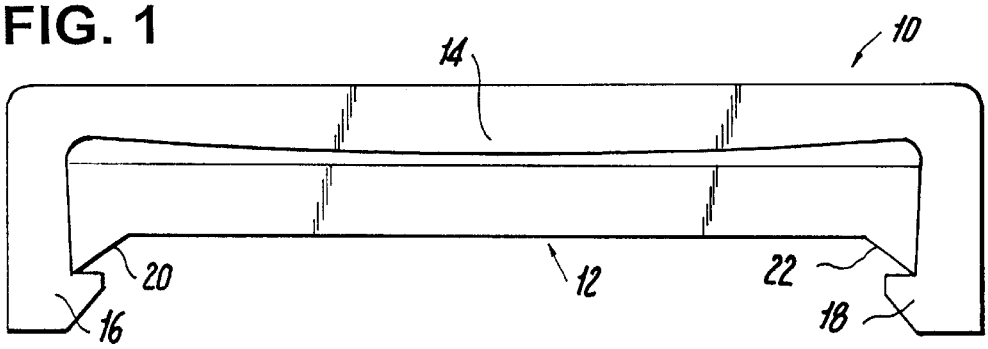
FIG. 1 illustrates an end view of the present invention.

FIG. 1 illustrates a composite 10 placed over and around a base 12. In a preferred embodiment, the base 12 can either be groove fitted or snapped into composite 10. There is a necessity to allow the composite 10 and the base 12 to move independently, because each of these two materials have different rates of expansion. In a preferred embodiment composite 10 is a wood polymer composite or a plastic composite. In a more preferred embodiment composite 10 is made of a high density polyethylene and recycled wood. One example of a presently made wood composite is TREX®. The composite 10 should be very thermally stable. For example, a 60 degree temperature swing should only give approximately a ⅛ inch change in length. In a preferred embodiment composite 10 has a lesser amount of strength than base 12. It is preferred that the base 12 be made of sturdier material than composite 10. The base 12 can be made of a sturdy plastic or other sturdy material used to make decks, but preferably is made of wood and most preferably of treated wood. A preferable wood base 12 is for example a southern pine. In a preferred embodiment composite 10 has a bulge 14 approximately in the center of composite 10. This causes the base 12 to crown slightly. In a preferred embodiment, in order to keep the base 12 from excessive movement, legs 16 and 18 surround the bottom of base 12.

In a preferred embodiment if composite 10 is damaged, it can be cut off, slid off, or otherwise removed without damaging base 12 below it. A new composite 10 can then be placed over base 12. Base 12 has leg engaging members 20 and 22 for slidably engaging legs 16 and 18.

If base 12 is damaged, composite 10 can be removed or slid off base 12, base 12 can then be replaced, placing the composite 10 back on a new base 12.

In a preferred embodiment base 12 is approximately six inches wide. In a preferred embodiment the height of composite 10 is approximately 1 ½ to 3 inches.

In a preferred embodiment the present invention provides a nail free and fastener free environment.

Figure 2:
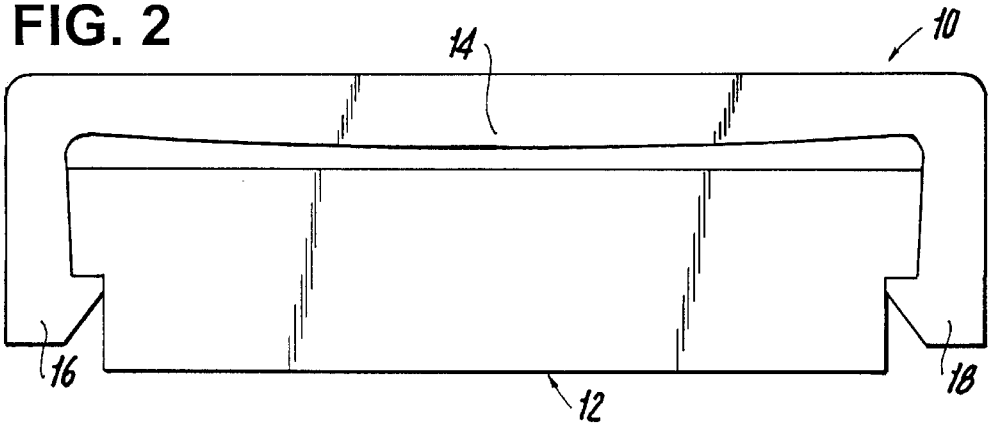
FIG. 2 illustrates an end view of the present invention.

FIG. 2 illustrates a further embodiment where base 12 extends beyond legs 16 and 18 for further support. Base 12 can be of any configuration which allows composite 10 to be placed over base 12.

Figure 3:
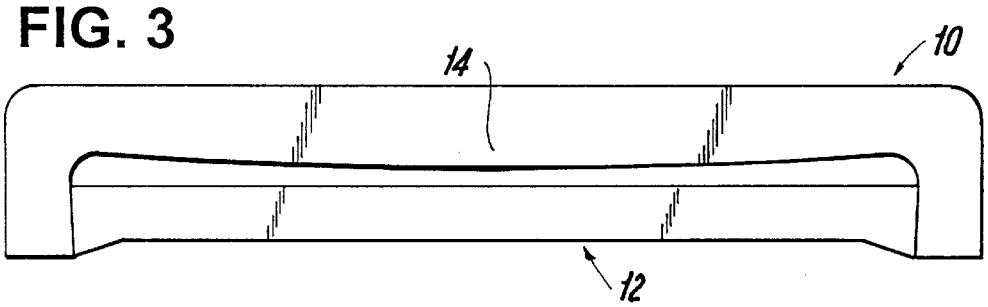
FIG. 3 illustrates an end view of the present invention.

FIG. 3 illustrates a further embodiment where composite 10 has no legs for securing base 12. However, base 12 fits securely within composite 10. Preferably a fastener is not required to secure base 12 to composite 10. However, if a fastener is required, the fastener should allow enough movement between base 12 and composite 10 to allow for differences in expansion rate.

Figure 4:
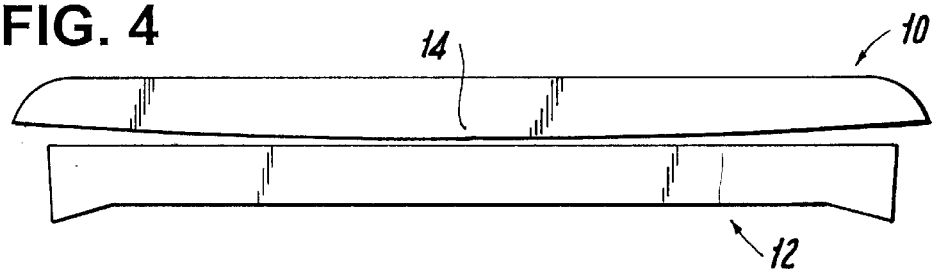
FIG. 4 illustrates an end view of the present invention.

FIG. 4 illustrates a composite 10 covering base 12. In this embodiment a fastening device is preferably used to secure composite 10 to base 12.

While preferred embodiments of the present invention have been described, variations thereto will occur to those skilled in the art and are within the scope of the present inventive concepts which are delineated by the following claims

What is claimed is:

1. A deck product comprising:

a composite;

a base;

said composite covering said base;

said composite being directly on top of said base, said base and said composite being removably attached;

said composite including a bulge.

2. The product of claim 1, wherein said composite is a wood polymer composite or a plastic composite.

3. The product of claim 1, wherein said base is made of wood.

4. The product of claim 1, wherein said composite has a first leg and second leg.

5. The product of claim 1, wherein said composite is arranged to be slid off said base.

6. The product of claim 1, wherein said base and said composite are engaged via a groove connection.

7. The product of claim 1, wherein said base and said composite are engaged via a snap fit connection.

8. The product of claim 1, wherein said deck product provides a nail free and fastener free environment.

9. The product of claim 1, wherein said product is adapted to be placed on an existing deck.

10. The deck product of claim 1 wherein said composite comprises polyethylene and wood.

11. The deck product of claim 1 wherein the height of said composite is approximately 1½ inches to 3 inches.

12. The deck product of claim 1 wherein said bulge is in approximately the middle of said composite.

13. The deck product of claim 1 wherein said bulge is a rounded bulge.

14. A deck product comprising;

a combination of a composite and a base;

said composite covering said base;

said composite being directly on top of said base;

said base and said composite being removably attached;

said composite including a bulge.

* * * * *